US005622361A

United States Patent [19]

Cole, Jr.

[11] Patent Number: 5,622,361

[45] Date of Patent: Apr. 22, 1997

[54] METHOD OF AND APPARATUS FOR SEPARATING AND FEEDING WORKPIECES OF LIMP MATERIAL FROM A STACK THEREOF

[75] Inventor: William R. Cole, Jr., Shelbyville, Tenn.

[73] Assignee: Ark, Inc., Shelbyville, Tenn.

[21] Appl. No.: 428,491

[22] Filed: Apr. 27, 1995

[51] Int. Cl.[6] ..... B65H 3/42

[52] U.S. Cl. ..... 271/16; 271/23

[58] Field of Search ..... 271/16, 17, 23, 271/35, 117, 118, 10.14–10.16, 131, 133

[56] References Cited

U.S. PATENT DOCUMENTS

| | | | |
|---|---|---|---|
| 626,676 | 6/1899 | Crowell . | |
| 655,668 | 8/1900 | Bilgram et al. | 271/23 |
| 715,764 | 12/1902 | Dick | 271/23 |
| 823,936 | 6/1906 | Dick | 271/23 |
| 859,853 | 7/1907 | Stewart | 271/10 |
| 977,758 | 12/1910 | Taylor | 271/118 |
| 1,088,961 | 3/1914 | De Blonay | 271/23 |
| 3,281,143 | 10/1966 | Mommsen et al. | 271/23 |
| 3,369,803 | 2/1968 | Walton et al. | 271/10 |
| 3,406,961 | 10/1968 | Walton | 271/10 |
| 3,425,685 | 2/1969 | Liva | 271/23 |
| 3,583,341 | 6/1971 | Birdsong et al. | 112/121.29 |
| 3,670,674 | 6/1972 | Conner, Jr. | 112/121.29 |
| 3,765,672 | 10/1973 | Conner, Jr. | 271/10 |
| 4,359,214 | 11/1982 | Eldridge | 271/5 |
| 4,372,549 | 2/1983 | Stiernspetz | 271/23 |
| 4,572,357 | 2/1986 | Pearl | 198/693 |
| 5,111,759 | 5/1992 | Hiramatsu et al. | 112/322 |
| 5,149,077 | 9/1992 | Martin et al. | 271/18.3 |
| 5,314,178 | 5/1994 | Cole, Jr. et al. | 271/18.3 |

FOREIGN PATENT DOCUMENTS

| | | | |
|---|---|---|---|
| 2241480 | 3/1975 | France | 271/18.3 |
| 455813 | 1/1928 | Germany | 271/23 |
| 144841 | 5/1992 | Japan | 271/23 |
| 7415310 | 5/1976 | Netherlands | 271/18.3 |

*Primary Examiner*—Boris Milef

*Attorney, Agent, or Firm*—Senniger, Powers, Leavitt & Roedel

[57] ABSTRACT

A method of and apparatus for separating and feeding workpieces of limp material one at a time and one another from the bottom of a stack of the workpieces wherein the stack is supported at the bottom with a gap in the support for exposing a portion of the bottom surface of the bottom workpiece, the support being movable to move the gap away from and back to a forward position. The portion of the bottom workpiece exposed in the gap in the forward position is fed rearward to form a loop in the bottom workpiece, the loop being gripped and pulled down which the support is moved to move the gap away from its forward position, the support then acting to peel the bottom workpiece away from the next workpiece above, followed by the release of the grip on the loop to release the bottom workpiece for being carried away.

18 Claims, 14 Drawing Sheets

METHOD OF AND APPARATUS FOR SEPARATING AND FEEDING WORKPIECES OF LIMP MATERIAL FROM A STACK THEREOF

The U.S. Government has a paid-up license in this invention and the right in limited circumstances to require the patent owner to license others on reasonable terms as provided by the terms of Contract DLA 900-87-C-0509 awarded the Department of Defense.

BRIEF SUMMARY OF THE INVENTION

This invention relates to a method of and apparatus or separating and feeding workpieces of limp material from a stack thereof, and more particularly to a method of and apparatus for separating and feeding fabric workpieces one at a time and one after another from the bottom of a stack thereof.

The invention may be regarded as involving an improvement upon the method of and apparatus for separating and feeding workpiece of limp material (e.g. fabric workpieces) one at a time and one after another from the bottom of a stack thereof disclosed in the coassigned U.S. Pat. No. 5,314,178 of William F. Cole, Jr. and Joel D. Clanton issued May 24, 1994. In that prior feeder, the bottom workpiece of the stack is separated from the stack by a picking cylinder, more particularly a roller having card cloth strips wrapped therearound for gripping of the bottom workpiece by penetration of the needles of the card cloth into the bottom workpiece for peeling the bottom workpiece away from the bottom of the stack. In certain instances, when handling workpieces of certain fabrics, the needles may become clogged with fibers after the apparatus has been in use for a time, requiring that the apparatus be taken out of operation for a time for cleaning. Other problems may arise on account of the use of needles.

Among the several objects of this invention may be noted the provision of a method of and apparatus for separating and feeding workpieces of limp material (e.g. fabric workpieces) one at a time and one after another from the bottom of a stack having an improved method and means for gripping the bottom workpiece for effecting the peeling thereof from the bottom of the stack without any undue tearing of fibers out of the cloth, thus avoiding the clogging problem and other problems which may arise from the use of needles.

In general, the method of this invention for separating the bottom workpiece from a stack of workpieces of limp material comprises supporting the stack at the bottom thereof with a gap in the support for exposing a portion of the bottom surface of the bottom workpiece extending completely across the bottom workpiece, and moving the support in cycles in each of which the gap is moved in one direction from a first position through a stroke in said one direction to a second position, and then moved in the opposite direction through a stroke in the opposite direction back to said first position. The stack is held against movement while the support moves thereunder. The gap has a dwell in its said first position at the end of its stroke in said opposite direction. While the gap dwells in its said first position, the portion of the bottom workpiece exposed in the gap is moved to form a loop in the bottom workpiece, the loop extending down into the gap. The loop is gripped and pulled down while the gap moves in said one direction in the course of its stroke in said one direction, the portion of the support on that side of the gap in said opposite direction passing between the bottom workpiece and the next workpiece above to peel the bottom workpiece down away from the next workpiece above, and the grip on said loop is released to release said bottom workpiece for being carried away.

In general, apparatus of this invention for separating the bottom workpiece from a stack of workpieces of limp material comprises a support for supporting the stack at the bottom thereof with a gap in the support for exposing a portion of the bottom surface of the bottom workpiece extending completely across the bottom workpiece. The support is movable underneath the stack to move the gap in one direction from a first position through a stroke in said one direction to a second position and movable in the opposite direction through a stroke in the opposite direction back to said first position. The stack is held against movement while the support moves thereunder. A drive for the support moves the gap in cycles in each of which the gap is moved in said one direction from its first position to its second position and then moved back from its second position to its first position. The gap has a dwell in its first position at the end of its stroke in said opposite direction. A loop former and loop gripper device is moveable up and down between a raised position engaging the bottom surface of the bottom workpiece exposed in the gap while the gap dwells in its said first position, and a lowered retracted position. The loop former and loop gripper device is operable when in raised position to form a loop in the bottom workpiece with the loop extending down into the gap, and to grip the loop on the downward movement of the device to the lowered retracted position. The drive for the support acts to move the gap from its first to its second position on the downward movement of the loop former and loop gripper device so that the portion of the support on that side of the gap in said opposite direction passes between the bottom workpiece and the next workpiece to peel the bottom workpiece down away from the next workpiece above, the loop being released to release the bottom workpiece for being carried away.

Other objects and features will be in part apparent and in part pointed out hereinafter.

BRIEF DESCRIPTION OF THE DRAWINGS

Corresponding reference characters indicate corresponding parts throughout several views of the drawings.

DETAILED DESCRIPTION

Figure 8:
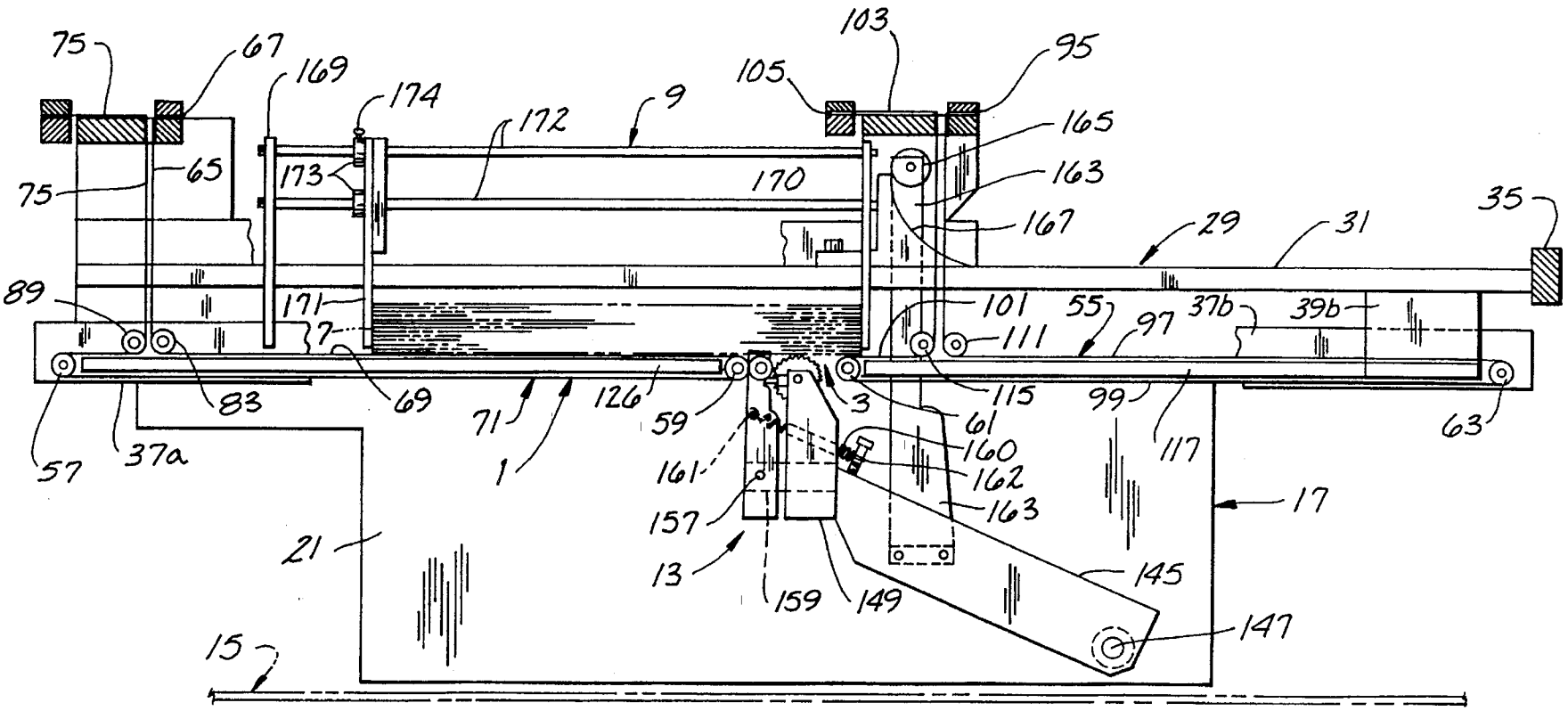
FIG. 8 is a schematic view generally in longitudinal section on line 8—8 of FIG. 1.
Figure 9:
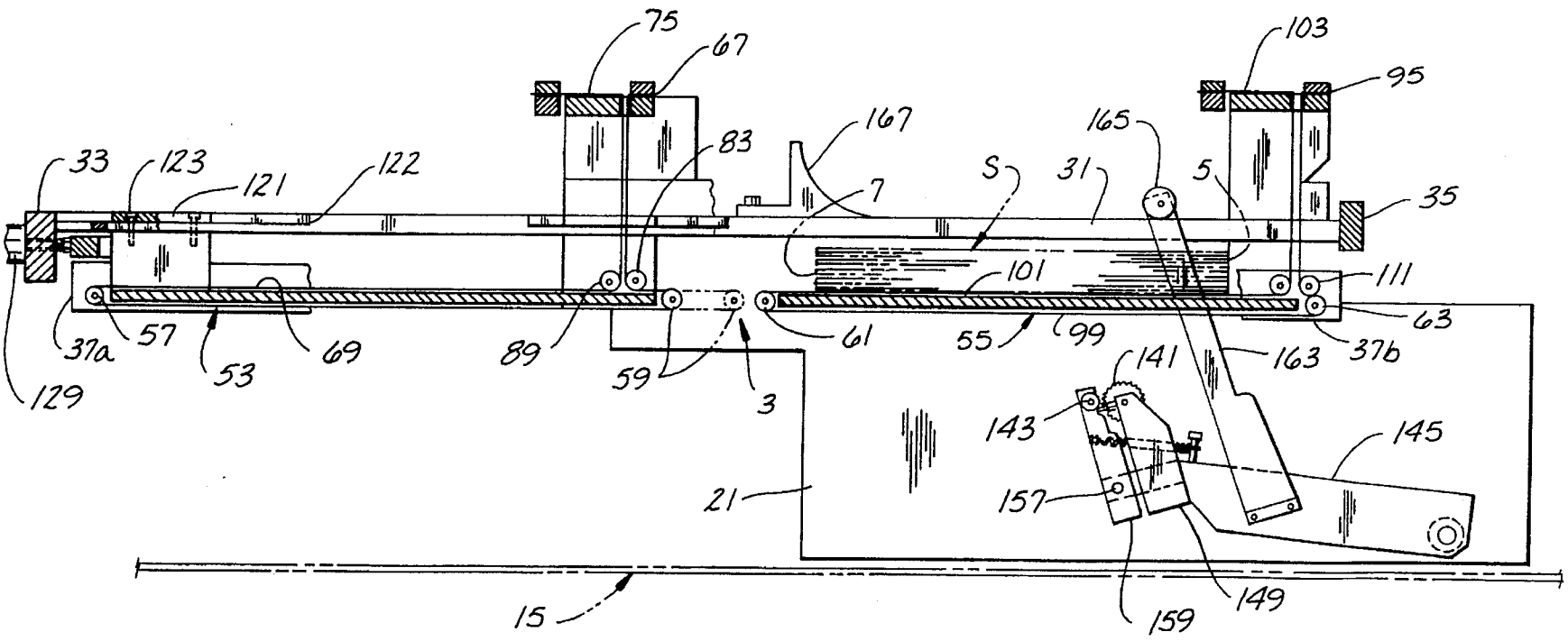
FIG. 9 is a schematic view generally in longitudinal section on line 9—9 of FIG. 2, showing in phantom a moved position of parts.
Figure 10:
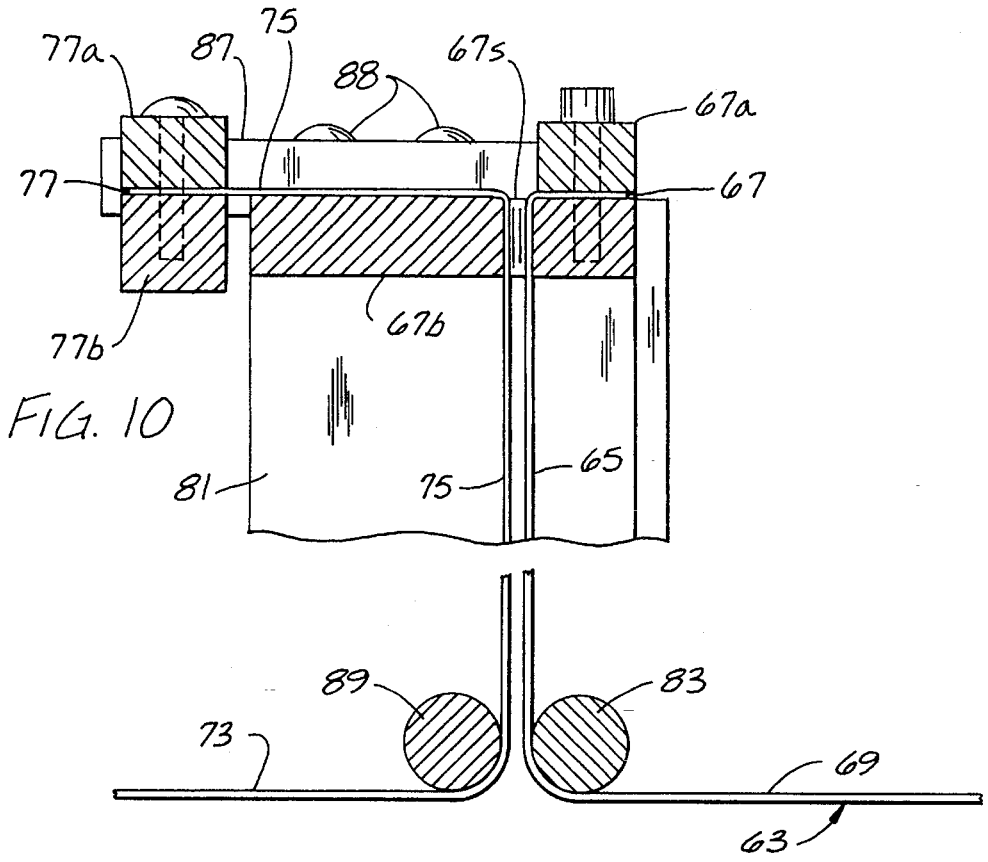
FIG. 10 is a view generally in section on line 10—10 of FIG. 1, on a larger scale than FIG. 1.
Figure 11:
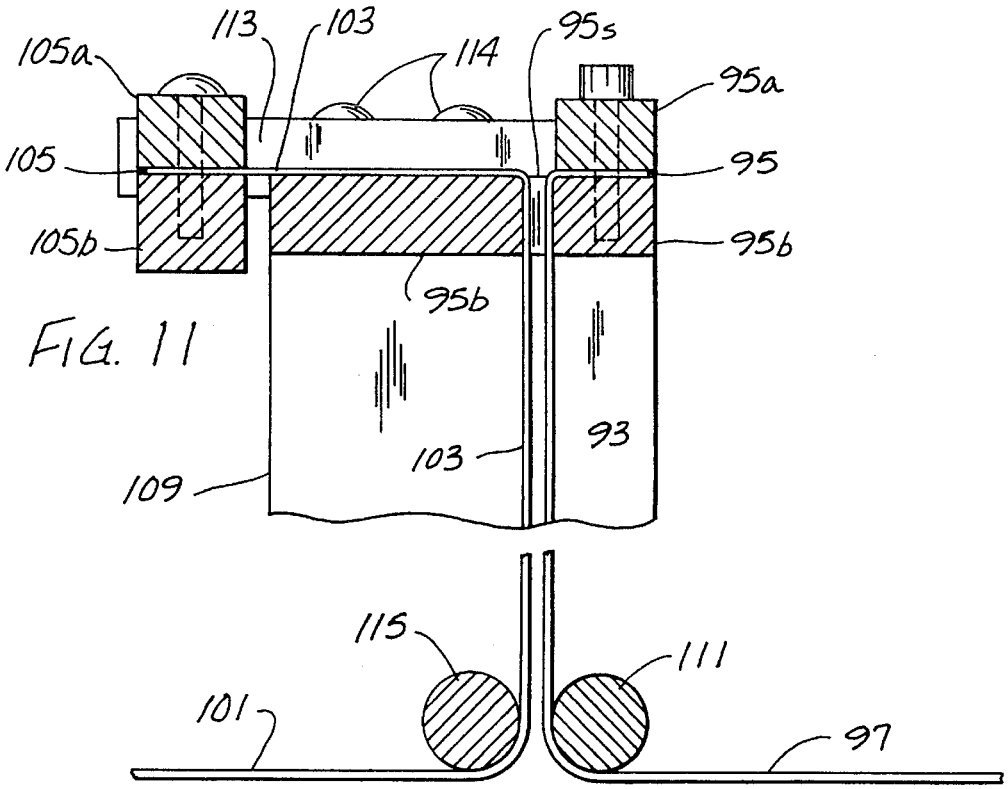
FIG. 11 is a view generally in section on line 11—11 of FIG. 1, on a larger scale than FIG. 1.
Figure 12:
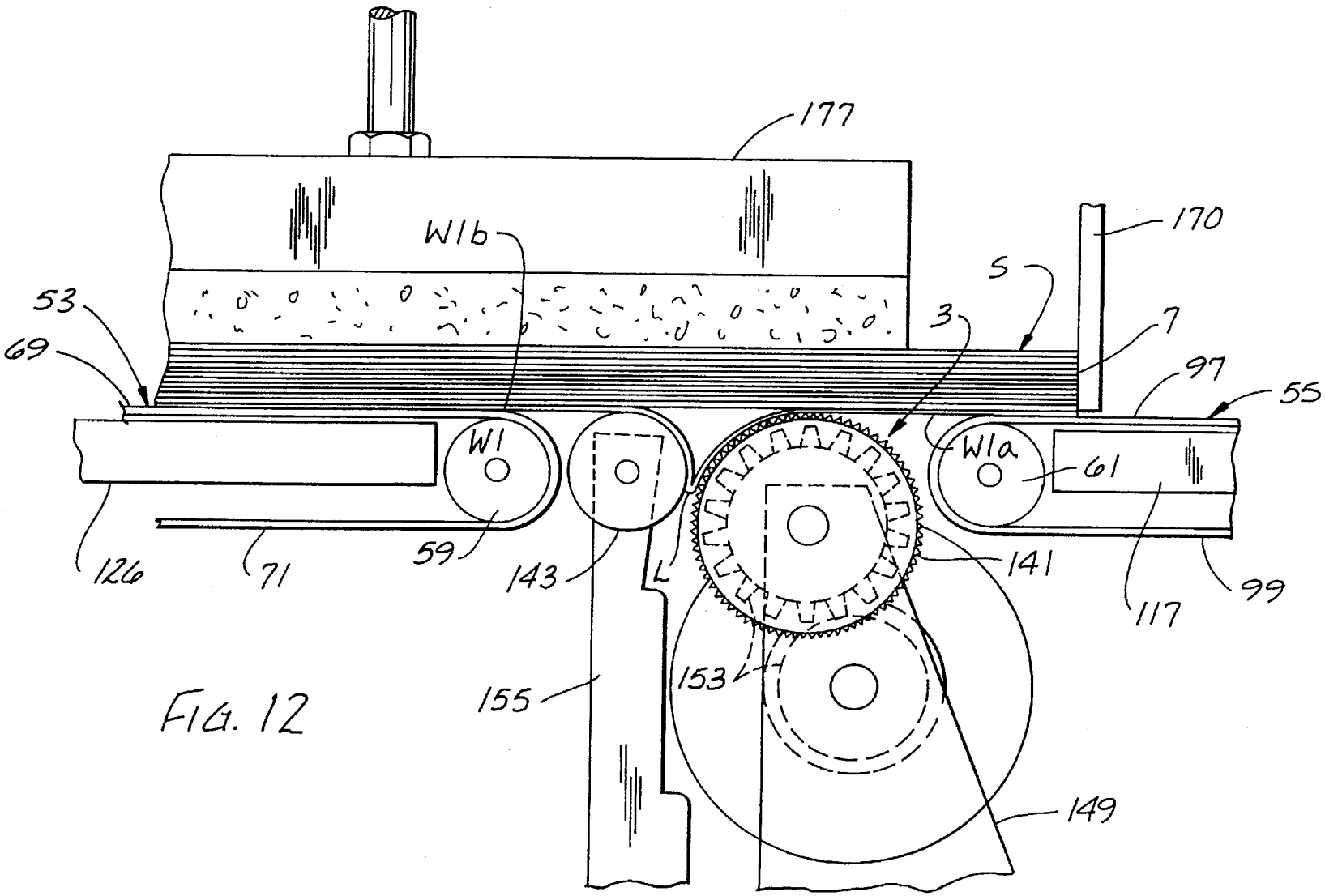
FIG. 12 is an enlarged fragment of FIG. 8 showing the forming of a loop in the bottom workpiece of the stack and the gripping of the loop for the pulling down of the forward end of the bottom workpiece.

Referring to the drawings, first more particularly to FIGS. 8 and 9 wherein the method and apparatus of this invention for separating the bottom workpiece from a stack of workpieces of limp material, e.g. fabric workpieces, are illustrated semi-diagrammatically, and to FIG. 12, the stack is designated S and the workpieces W, the bottom workpiece being specially designated W1. Broadly considered, the apparatus comprises a support designated in its entirety by the reference numeral 1 for supporting the stack S at the bottom thereof with a gap 3 in the support for exposing a portion of the bottom surface of the bottom workpiece W1, this exposed portion extending completely across the bottom workpiece (and thus extending completely across the stack). The support 1 is movable underneath the stack to move the gap 3 in what is referred to as rearward direction from the forward position of the gap in which it is shown in FIGS. 8 and 12 adjacent one end of the stack constituting the forward end of the stack (its end toward the right as viewed in FIGS. 8 and 10) and through a rearward stroke to a rearward position in which it is shown in FIG. 9 adjacent the other end of the stack constituting the rearward end of the stack. The forward end of the stack (illustrated as comprising rectangular workpieces of limp material, for example fabric) is indicated at 5 and its rearward end is indicated at 7. Means indicated generally at 9 is provided for holding the stack against forward and rearward movement while the support moves thereunder.

Figure 1:
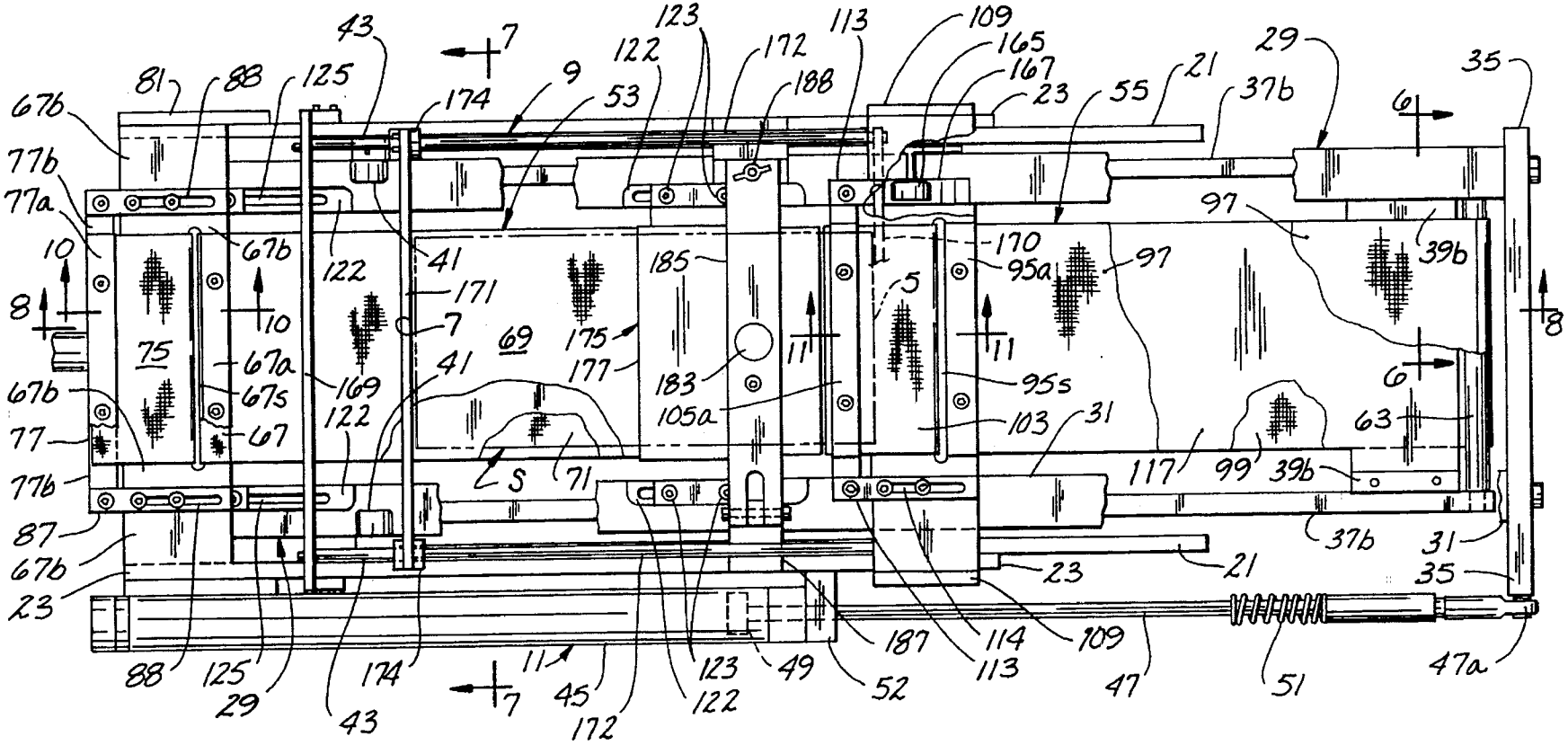
FIG. 1 is view in plan of an apparatus of this invention, with parts broken away and shown in section, and showing a carriage of the apparatus in a position thereof referred to as its forward position and showing in phantom a stack of workpieces in place on the apparatus.
Figure 2:
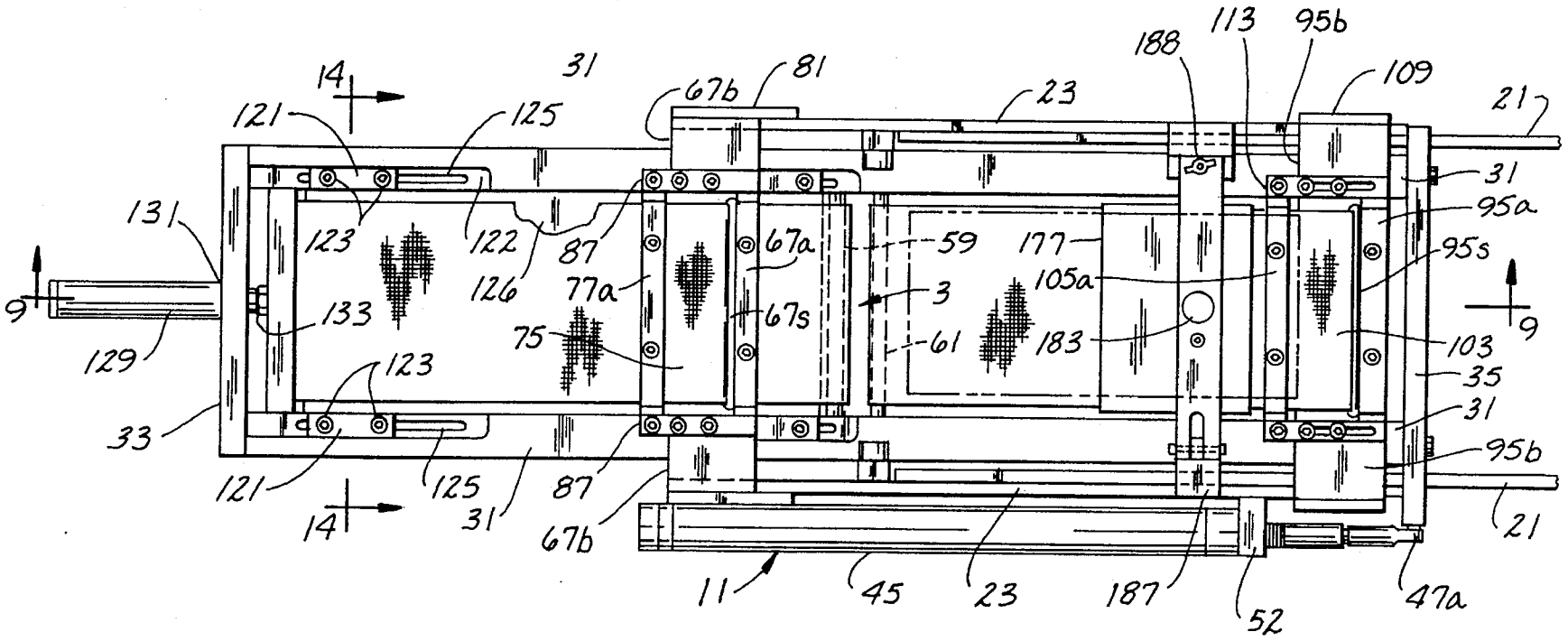
FIG. 2 is a view similar to FIG. 1, with parts omitted, showing the carriage in a position referred to as its rearward position, again showing the stack in phantom.
Figure 3:
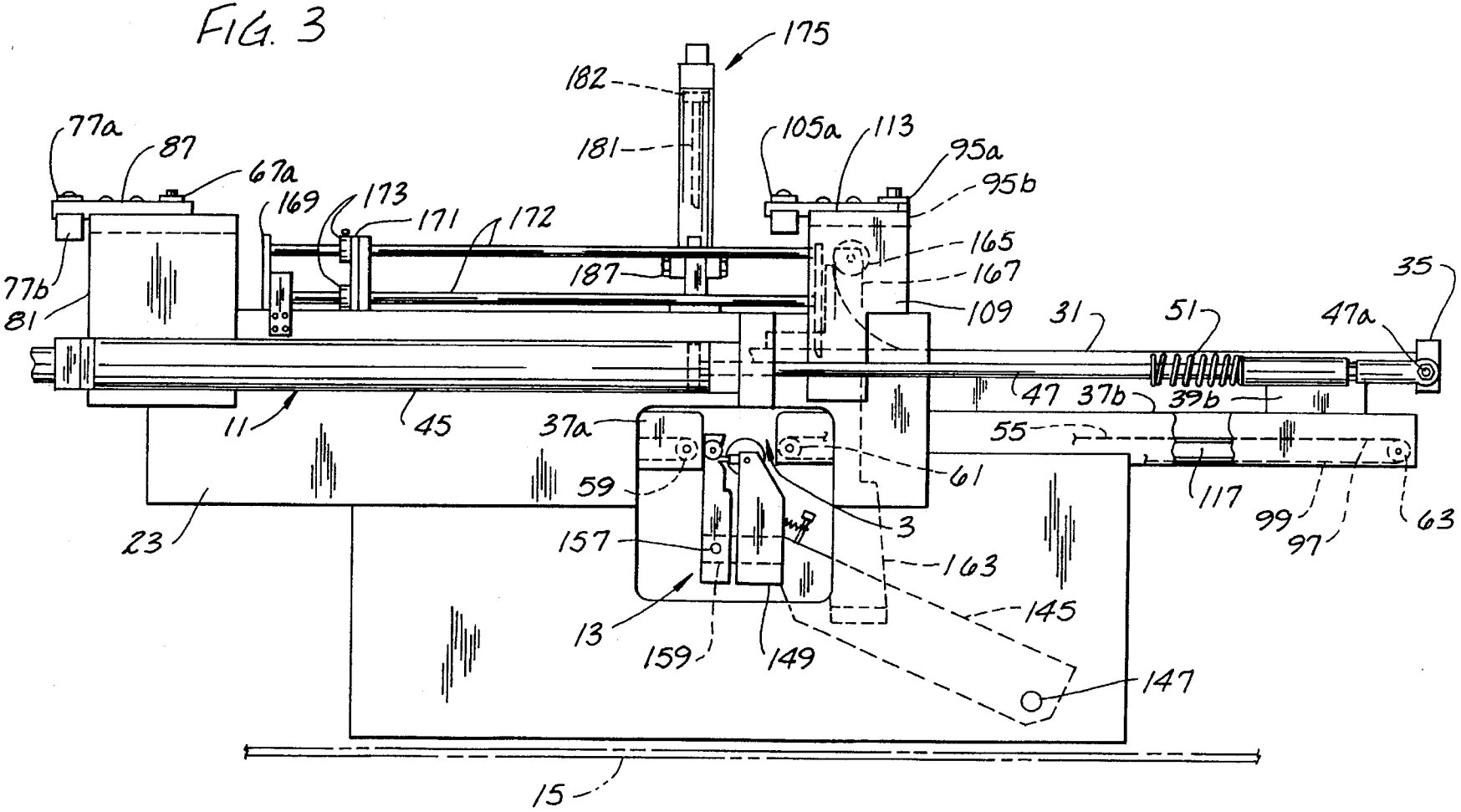
FIG. 3 is a view in elevation of one side of the apparatus, more particularly its right side as viewed in forward direction with respect to movement of the carriage, showing the carriage in its said forward position, with parts broken away.

Referring to FIGS. 1–3, at 11 is generally indicated a drive for the support 1 for moving the gap 3 in cycles in each of which the gap is moved rearward (toward the left as viewed in FIGS. 1–3, 8 and 12) through a rearward stroke from its FIGS. 8 and 12 forward position to its FIG. 9 rearward position and moved forward (toward the right as viewed in FIG. 9) through a forward stroke from its rearward position back to its forward position. The gap 3 has a dwell of relatively short duration at the end of its forward stroke before it starts back on a rearward stroke. It may also have a dwell of relatively short duration at the end of its rearward stroke before it starts back on its forward stroke.

Figure 13:
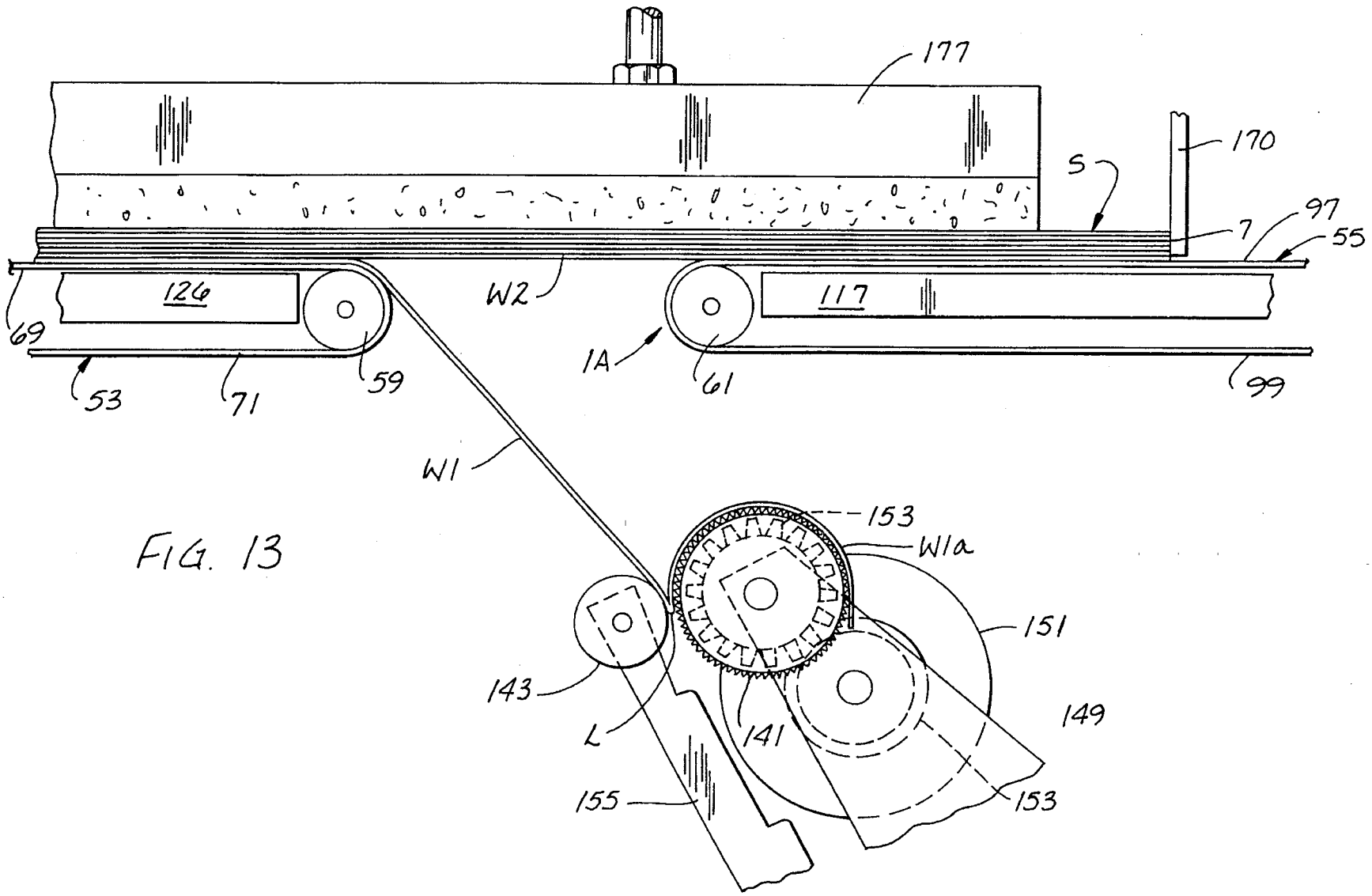
FIG. 13 is a view on the same scale as FIG. 12 showing the loop pulled down and the carriage moving rearward for effecting the peeling of the bottom workpiece away from the bottom of the stack.
Figure 14:
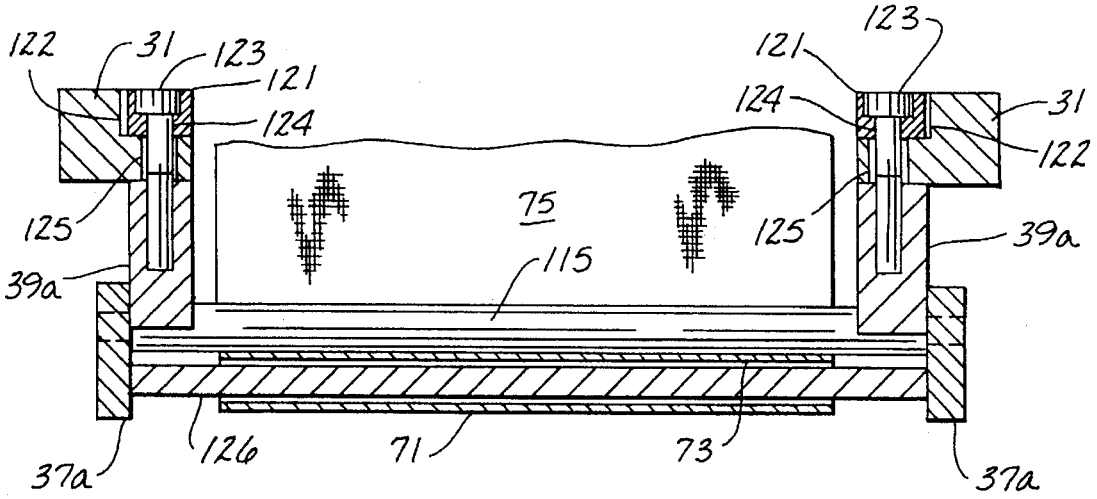
FIG. 14 is a view generally in transverse section on line 14—14 of FIG. 2.

A loop former and loop gripper device, designated 13 in its entirety, is movable up and down between a raised position (see FIGS. 8 and 12) engaging the bottom surface of the bottom workpiece W1 exposed in the gap 3 while the gap dwells in its forward position, and a lowered retracted position (see FIGS. 9 and 13). The loop former and loop gripper device 13 is operable when in its raised position to form a loop L (see FIG. 12) in the bottom workpiece, the loop extending down into the gap, and to grip the loop (more particularly to pinch the loop) on the downward movement of the device 13 toward its lower retracted position. The loop, being gripped or pinched in the device 13, is pulled down by the device 13 as the latter moves down, and this pulls the forward end portion W1*a* of the bottom workpiece W1 (the portion forward of the gap 3) out from under the next workpiece W2 of the stack to separate it from the bottom workpiece.

After the loop former and loop gripper device 13 has moved down to a point where it is withdrawn from the gap 3, and where the forward end portion W1*a* of the bottom workpiece W1 has been pulled out from under the forward end portion of the stack, the drive 11 operates to move the support 1 to move the gap 3 rearward to its FIG. 9 rearward position. This movement of the gap may start while the device 13 is moving down. On the rearward movement of the gap, the portion 1A of the support 1 forward of the gap passes between the bottom workpiece W1 and the next workpiece W2 and functions to peel the bottom workpiece down away from the next workpiece. With the loop former and loop gripper device 13 down, the device is operated to release the pinched loop L, thereby releasing the bottom workpiece W1 for being carried away. As illustrated, the apparatus comprises a take-away conveyor 15 having a reach travelling under the support 1 in forward direction as shown (i.e. toward the right as viewed in FIGS. 8 and 9) for taking away the released bottom workpiece and feeding it to or through workpiece processing equipment (not shown). This conveyor may be similar to the conveyor 28 shown in the aforesaid U.S. Pat. No. 5,314,178 which is incorporated herein by reference, and to which reference may be made for details. The lower end of the bottom workpiece comes down on the conveyor and is carried forward on the conveyor, the workpiece being laid flat on the conveyor.

Figure 4:
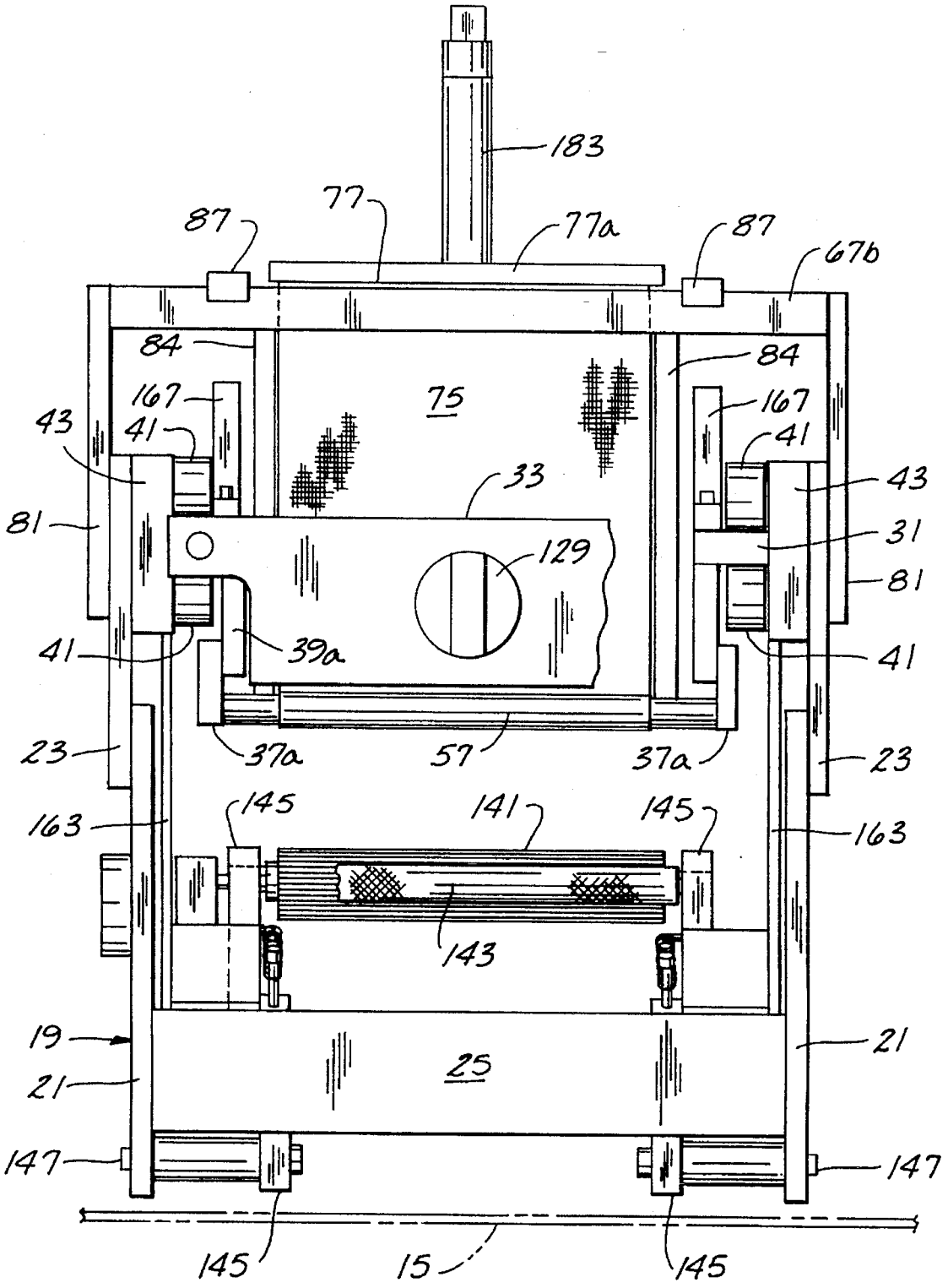
FIG. 4 is a view in elevation of the apparatus from its rearward end (its left end as viewed in FIG. 3), with parts broken away.
Figure 5:
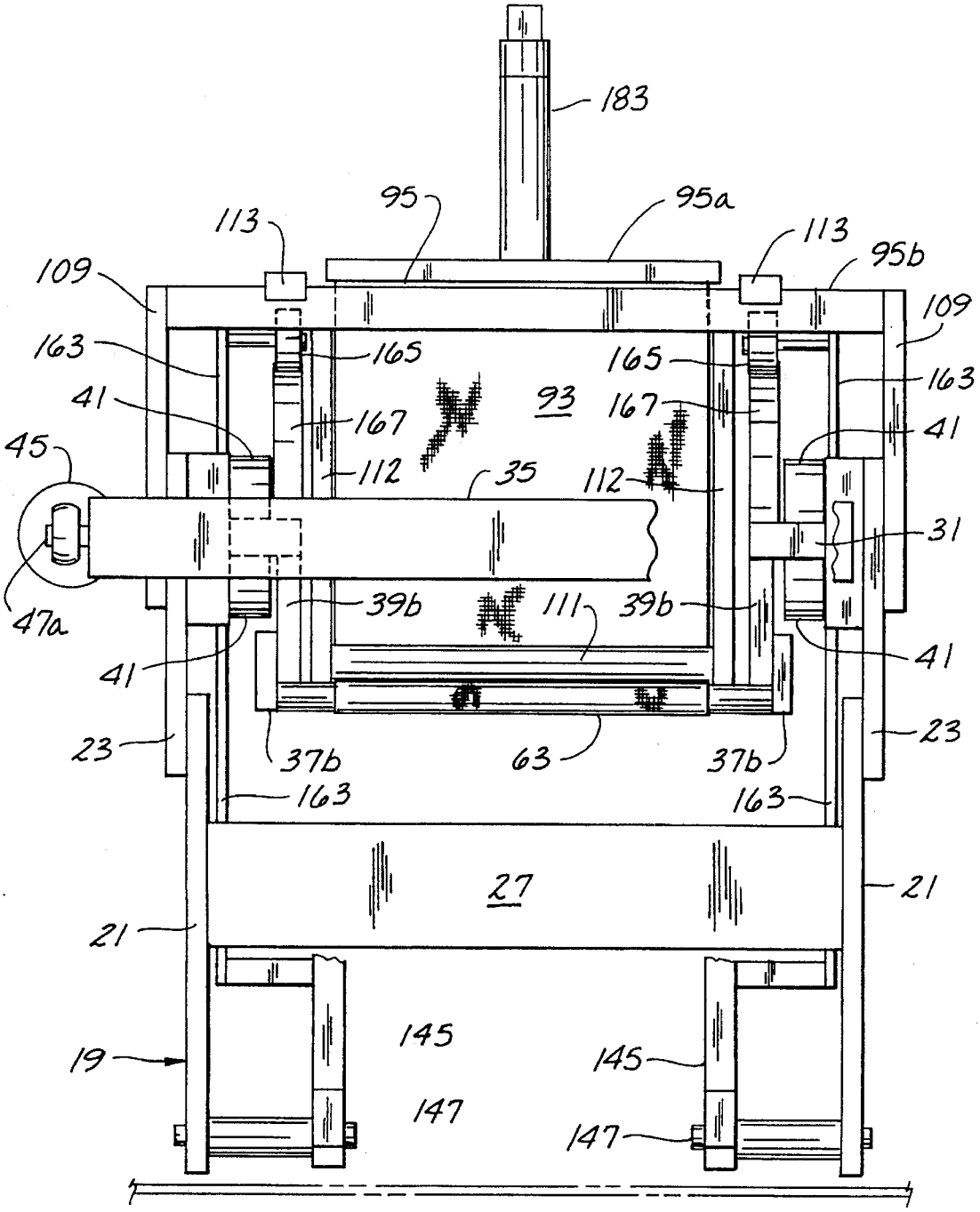
FIG. 5 is a view in elevation of the apparatus from its forward end (its right end as viewed in FIG. 3), with parts broken away.
Figure 6:
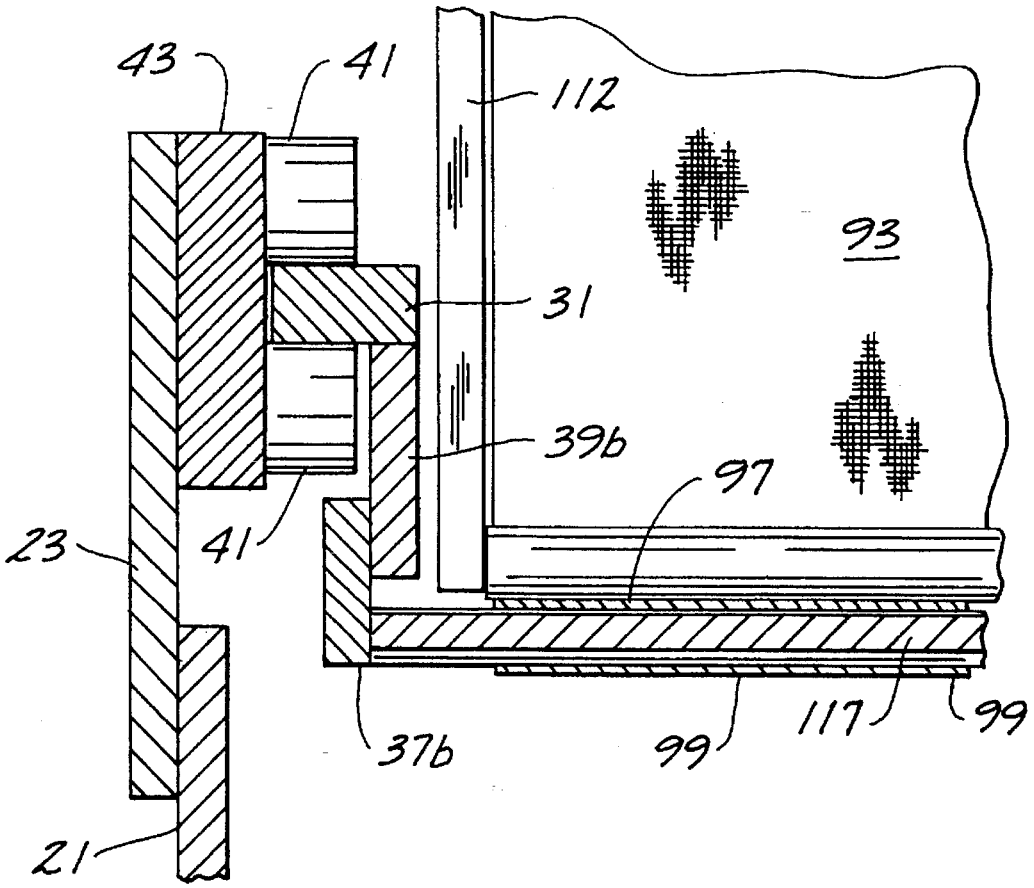
FIG. 6 is a view generally in transverse section on line 6—6 of FIG. 1 with parts omitted.
Figure 7:
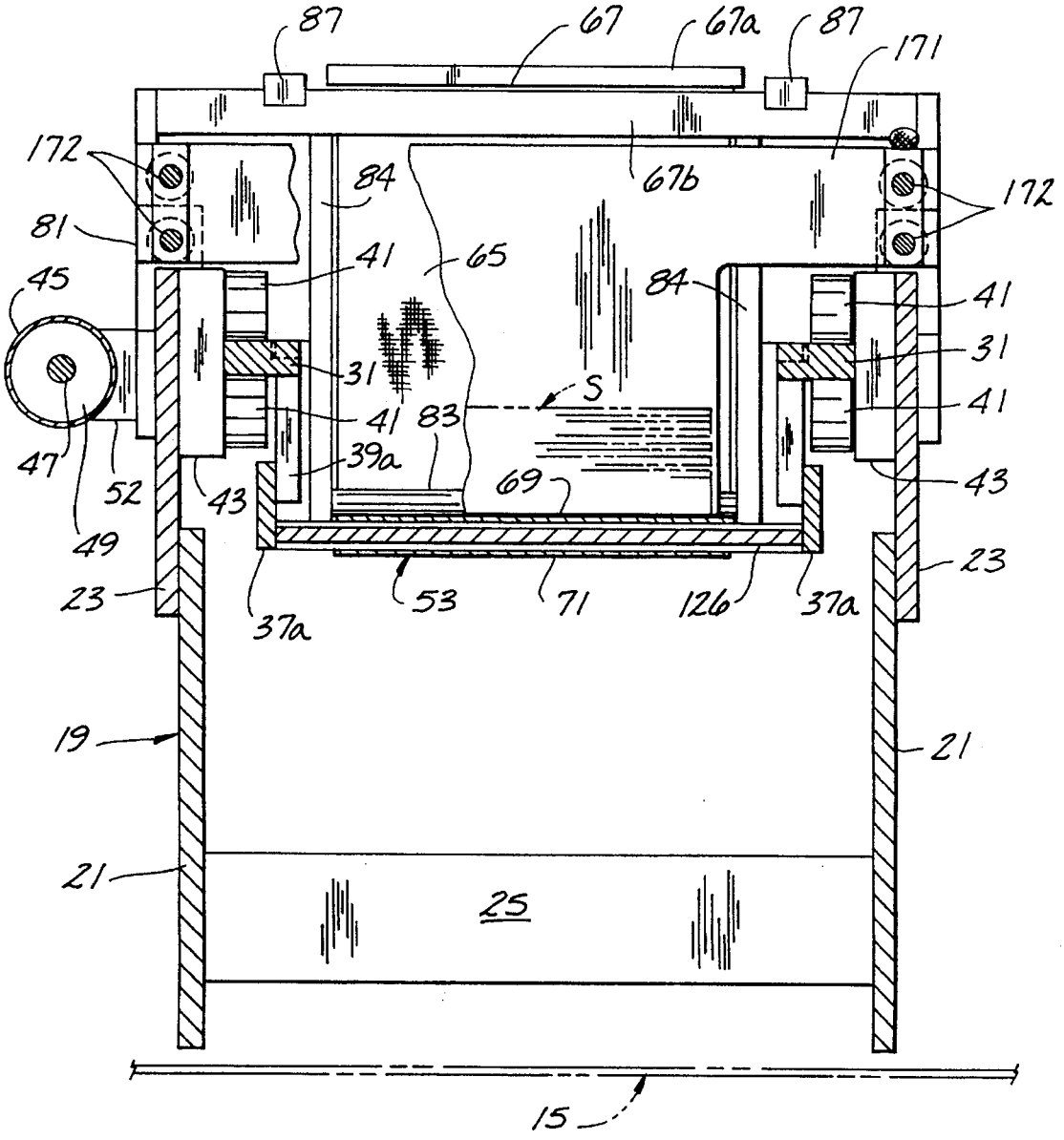
FIG. 7 is a view generally in transverse section on line 7—7 of FIG. 1 with parts omitted.

In further detail, the apparatus comprises a base frame structure generally designated 17 comprising a pair of side walls each designated 19 in its entirety and comprising lower side plates 21, upper side plates 23, and rear end and forward end members 25 and 27 (see FIGS. 4 and 5) for the lower side plates 21. The end members hold the side walls 19 in position extending vertically in parallel spaced-apart relation. The base frame structure 17 is suitably supported on a suitable base (not shown) in position above the upper reach of the conveyor 15, i.e., with the side walls 19 generally in vertical planes on opposite sides of the conveyor, the upper reach of the latter extending under the base frame structure 17 from its rearward end to its forward end, the arrangement allowing for passage out from under the forward end of the apparatus of a workpiece lying flat on the conveyor. The upper side plates 23 are secured to the outside of the lower side plates 21 adjacent the upper edges thereof and extend up above the upper edges of plates 21.

The stack support 1 (having the gap 3) comprises a carriage designated in its entirety by the reference numeral 29 mounted for linear movement (linear reciprocation) in forward and rearward direction longitudinally of the apparatus. The carriage 29 comprises a pair of side rails each designated 31 extending generally horizontally parallel to one another at opposite sides thereof, and rearward and forward crossbars 33 and 35 at the rearward and forward ends thereof holding the side rails in their spaced-apart parallel relationship. The side rails 31 constitute upper carriage side rails, the carriage further comprising a pair of rearward lower side rails each designated 37*a* and a pair of forward lower side rails 37*b*. The rearward lower side rails 37*a* are suspended from the upper side rails 31 by means of hangers such as indicated at 39*a* which are slidable longitudinally with respect to rails 31 as will be described later. Rails 37*b* are suspended from the upper side rails 31 by means of hangers such as indicated at 39*b*. The hangers 39*b* are secured to rails 31 and rails 37*b* are secured to the hangers, rails 37*b* thus being fixed relative to rails 31. Each of the rearward lower side rails 37*a* is aligned with and spaced longitudinally with respect to the respective forward lower side rails 37*b* to provide for the gap at 3. That is, the forward end of each rearward lower side rail 37*a* is spaced from the rearward end of the respective forward lower side rail 37*b*. The upper side rails 31 are guided for linear movement in forward and rearward direction (movement longitudinally of the apparatus) by means of guide rollers such as indicated at 41 carried by blocks 43 mounted on the inside of the upper side plates 23 of the base frame structure. The carriage 29 is linearly movable longitudinally with respect to the apparatus by the aforesaid drive 11, shown as comprising an elongate air cylinder 45 mounted in position extending horizontally longitudinally of the apparatus on the outside of one of the upper side plates 23 (specifically the right-hand side plate 23 as viewed in forward direction). The air cylinder has a piston rod 47 extending from a piston 49 therein through its forward end (its rod end) to a connection at 47*a* with the right-hand end of the forward crossbar 35 of the carriage (right-hand as viewed looking forward), this crossbar extending out laterally beyond the upper carriage side rail 31 at the respective side of the carriage. A spring 51 on the piston rod is engageable with a support 52 for the rod end of the cylinder for cushioning purposes. The air cylinder 45 is operable to move the carriage back and forth between the forward position in which the carriage 29 is illustrated in FIGS. 1 and 8 and the rearward position in which it is illustrated in FIGS. 2 and 9.

The stack support 11 further comprises a first belt 53, which may be referred to as the rearward belt, and a second belt 55, which may be referred to as the forward belt, and first, second, third and fourth belt guides 57, 59, 61 and 63 carried by the carriage 29. Each of these belt guides comprises a guide roller extending generally horizontally transversely of the carriage. The first belt guide 57 is located generally adjacent the rearward end of the carriage 29. The second belt guide 59 is located forward of the first guide and defines the rearward edge of the gap 3. The third belt guide 61 is located forward of the second guide and defines the forward edge of the gap 3. The fourth belt guide 63 is located forward of the third guide roller adjacent the forward end of the carriage.

The first belt 53 has a first end portion 65 fixed to the frame structure 17 as indicated at 67 and hence fixed against the movement with the carriage 29, a first upper reach 69 extending generally horizontally forward from said fixed end portion 65 to the second guide 59, and a lower reach 71 extending generally horizontally rearward back to the first guide 57, being trained around the latter and having a second upper reach 73 extending generally horizontally forward generally coplanar with the first upper reach 69 to a second end portion 75 of the belt which is fixed to the frame structure 17 as indicated at 77 and hence fixed against movement with the carriage. The first fixed end portion 65 of the first belt 53 is shown as fixed at 67 to the frame structure by extending through a slot 67*s* in a bridge 67*b* which extends generally horizontally transversely with respect to the apparatus above the carriage 29 between a pair of side members or uprights 81 secured on the outside of plates 23 of the frame structure, and being clamped down on top of the bridge 67*b* forward of the slot by a clamp bar 67*a*. The stated first fixed end portion 65 of the belt 53 extends generally vertically upwardly to the clamp means at 67 from a belt guide roller 83 around which this belt is trained at the rearward end of its upper reach 69. Roller 83 extends generally horizontally transversely of the apparatus mounted at its ends on supports 84 extending down from the bridge 67*b*. The second fixed end portion 75 of the first belt 53 is shown as fixed at 77 to the frame structure by extending through the slot 67*s* and rearward over the bridge 67*b* and being clamped down by a clamp bar 77*a* against a bar 77*b* supported rearward of and parallel to bridge 67*b* by a pair of arms 87 cantilevered rearward from the bridge and adjustable on the latter as indicated at 88 for belt adjustment purposes. The stated second fixed end portion 75 of the belt extends generally vertically upwardly from a guide roller 89 around which the belt is trained at the forward end of its reach 73. Roller 89 extends generally horizontally transversely of the apparatus adjacent and rearward of roller 83, being mounted at its ends on the supports 84.

The second belt 55 has a first end portion 93 fixed to the frame structure 17 as indicated at 95 and hence fixed against movement with the carriage 29, a first upper reach 97 extending generally horizontally forward from said fixed end portion 93 to the said fourth guide 63. The belt 55 is trained around the said fourth guide 63 and has a lower reach 99 extending generally horizontally rearward to the third belt guide 61, being trained around the latter and having a second upper reach 101 extending generally horizontally forward coplanar with the said first upper reach 97 to a second end portion 103 of the belt 55 which is fixed to the frame structure 17 as indicated at 105. The stated first fixed end portion 93 of the belt 55 is shown as fixed at 95 to the frame structure by extending through a slot 95*s* in a bridge 95*b* which extends generally horizontally transversely with respect to the apparatus above the carriage 29 between a pair of side members or uprights 109 secured on the outside of plates 23 of the frame structure, and being clamped down on top of the bridge forward of the slot by a clamp bar 95*a*. The stated first end portion 93 of the belt 55 extends generally vertically upwardly to the clamp means at 95 from a belt guide roller 111 around which this belt is trained at the rearward end of its upper reach 97. Roller 111 extends generally horizontally transversely of the apparatus mounted at its ends on supports 112 extending down from the bridge 95*b*. The second fixed end portion 103 of the second belt 55 is shown as fixed at 105 to the frame structure by extending through the slot 95*s* and rearward over the bridge 95*b* and being clamped down by a clamp bar 105*a* against a bar 105*b* supported rearward of and parallel to bridge 95*b* by a pair of arms 113 cantilevered rearward from the bridge and adjustable on the latter as indicated at 114 for belt adjustment purposes. The stated second fixed end portion 103 of the belt 55 extends generally vertically upwardly from a guide roller 115 around which the belt is trained at the forward end of its reach 101. Roller 115 extends generally horizontally transversely of the apparatus adjacent and rearward of roller 111, being mounted at its ends on the supports 112. At 117 is indicated a plate, which may be referred to as the forward platen, extending transversely with respect to the carriage 29 between the forward lower side rails 37*b* of the carriage constituting a support for the upper reaches 97 and 101 of the belt 55.

Figure 2A:
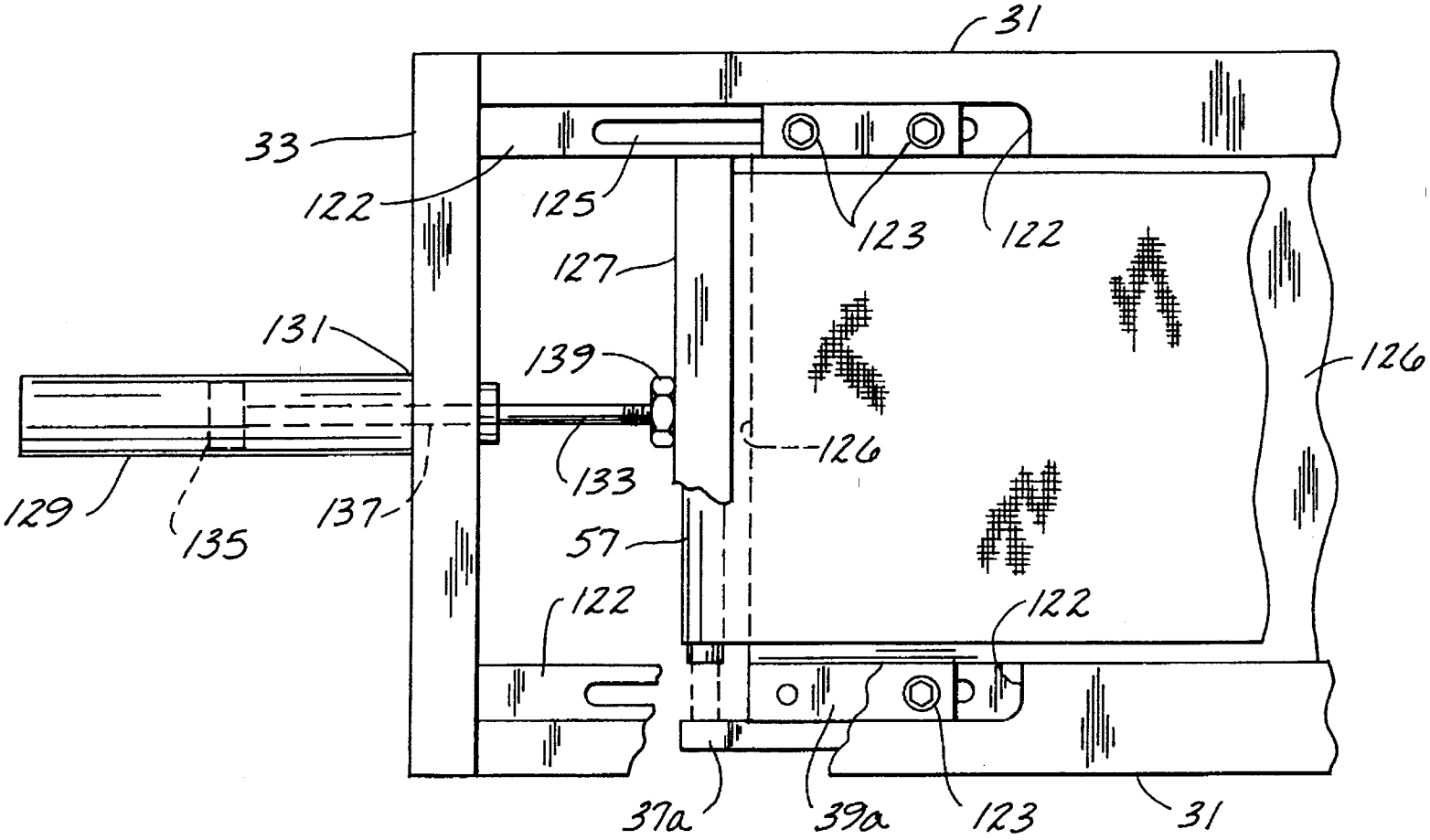
FIG. 2A is an enlarged fragment of FIG. 2 showing a moved position of parts.

The belt guide rollers 61 and 63 are carried directly by the forward lower side rails 37*b* of carriage 29, journalled at their ends in rails 37*b*, their axes being fixed with respect to rails 37*b* and the carriage 29. The belt guide rollers 57 and 59, rather than being fixed with respect to the carriage 29, are movable longitudinally relative to the carriage 29 between a rearward position relative to the carriage 29 wherein the gap 3 is relatively wide open (the FIG. 8 gap-open position) and a forward position relative to the carriage 29 wherein the gap 3 is substantially closed as shown in phantom in FIG. 9. Slides 121 slidable longitudinally of the rails 31 in recesses 122 in the top of rails 31 have screws 123 extending down through holes 124 therein and through elongate longitudinal slots 125 in the rails 31, the screws having their lower ends threaded in hangers 39*a* carrying the rearward lower side rails 37*a*. These side rails 37*a* are at the sides of an elongate horizontal plate 126 which may be referred to as the rearward platen of the apparatus. A crosshead 127 extends between the rearward ends of the rails 37*a*. Guide roller 57 is mounted at rearward end of the platen extending between and journalled at its ends in the rails 37*a*. Guide roller 59 is mounted at the forward end of the platen extending between and journalled at its ends in the rails 37*a*. The assembly of parts comprising the platen 126 with the side rails 37*a* and the crosshead 127 may be referred to as an auxiliary carriage movable between the stated rearward and forward positions relative to the main carriage 29. Thus movement is effected by means of an air cylinder 129 having its rod end 131 secured to the rear crossbar 33 of the main carriage. This air cylinder extends rearward from the crossbar 33 and has its piston rod 133 extending from piston 135 therein through a hole at 137 in the crossbar 33 to a connection at 139 with the crosshead 127 at the rearward end of the platen 126. The arrangement is such that with the piston rod 133 in retracted position as shown in FIG. 2, the rearward lower side rails 37*a* carrying guide rollers 57 and 59 for the belt 53 occupy a retracted position wherein roller 59 and the forward end of the belt 53 are spaced a maximum distance from roller 61 and the rearward end of the belt 55 in gap-open position (FIG. 8), and, with the piston rod 133 extended (FIG. 2A), the rails 37*a* occupy the extended position wherein roller 59 and the forward end of the belt are in contact or spaced a minimum distance in narrow-gap position (shown in phantom in FIG. 9).

With the carriage 29 in its forward position (FIGS. 1, 3 and 8) and with the rails 37*a* in their retracted position relative to the carriage 29, the gap 3 is situated in its FIG. 8 forward position and is wide open for operation of the loop former and loop gripper device 13 to form the loop L in the bottom workpiece, and to grip the loop and pull it down. Referring to FIGS. 12 and 13, and to FIGS. 3, 8 and 9, the loop former and loop gripper device 13 is shown to comprise a feed roller 141 and a loop gripping member 143 carried by a pair of arms 145 pivoted as indicated at 147 on the inside of side plates 21 of the base frame structure 19 for swinging movement on a generally horizontal axis extending transversely of the apparatus adjacent the forward end of the base frame structure. The arms extend generally rearward from their pivots. The feed roller 141 extends transversely of the apparatus, being mounted at its ends in a pair of feed roller mounting members 149 which extend upwardly from the arms 145 at their free ends. Carried on one of the members 149 at one side of the apparatus is a reversible rotary air motor 151 connected by gearing 153 to the feed roller 141 for driving it through a fraction of a revolution when the feed roller is raised into engagement with the bottom surface of the bottom workpiece W1 in the direction for feeding forward portion W1*a* of the bottom workpiece W1 in rearward direction relative to the carriage 29 to form the loop L in the gap 3. As viewed in FIG. 12 this direction is counterclockwise. The motor is reversible for driving the feed roller 141 in the reverse direction for a purpose that will be subsequently described. The feed roller 141 is adapted to frictionally engage the surface of the workpiece, e.g. it is a relatively soft rubber roller with surface corrugations extending lengthwise, for rearward feed of the forward end portion W1*a* the bottom workpiece W1 without scraping it so as to avoid scraping off fibers from the workpiece. The loop gripper member 143 comprises a rigid roller mounted at its ends at the upper ends of a pair of roller mounting members 155 each pivoted as indicated at 157 at the ends of a crossbar 159 spanning the rearward ends of the arms 145. The gripper roller mounting members extend up from their pivot at 157. The gripper roller 143 extends transversely with respect to the apparatus just to the rear of the feed roller 141 and is biased toward engagement with the feed roller by a pair of tension springs 160 each connected at one end as indicated at 161 to a respective member 155 and at its other end as indicated at 162 to a respective arm 145.

The loop former and gripper device 13, more particularly the assembly comprising arms 145, members 149 and 155 carrying rollers 141 and 143 and the air motor 151, is swingable up and down between the lowered retracted position in which it appears in FIGS. 9 and 13 and the raised position in which it appears in FIGS. 8 and 12 by mechanism comprising fingers 163 extending up from the arms 145 having cam follower rollers 165 at their upper ends. The stated assembly is gravity-biased downwardly to its said lowered retracted position as determined by engagement of the follower rollers 165 with the top surfaces of the upper side rails 31 of the carriage 29. Cams 167 are mounted on top of the rails 31 for engagement with the cam follower rollers 165 as the carriage 29, in being moved by the air cylinder 45 from its rearward to its forward position, approaches its forward position, to swing the stated assembly up from its lowered retracted position of FIGS. 9 and 13 to its raised position of FIGS. 8 and 12 wherein the feed roller 141 and the pinch roller 143 engage the-bottom surface of the bottom workpiece W1 exposed in the gap 3.

With the carriage 29 in its forward position of FIGS. 1, 3 and 8, a stack S of the limp workpieces is placed in position for the separation and feeding of the workpiece in the stack one at a time and one after another from the bottom of the stack, in which position the forward end portion of the stack bears on the upper reach 101 of the forward belt 55 and the rearward end portion of the stack bears on the upper reach 69 of the rearward belt 53. For determining the said position of the stack and maintaining it therein, the apparatus is provided with the aforesaid means 9 comprising plates 169 and 170 extending vertically transversely with respect to the apparatus bridging the upper side plates 23 of the apparatus. Plate 169 is located adjacent the forward side of the structure which includes the rearward bridge 67*b*. Plate 170 is located adjacent the rearward side of the structure which includes the forward bridge 95*b*. The stack is placed on the upper reach 69 of the rearward belt 53 and the upper reach 101 of the forward belt 55 with its forward end 5 engaging the forward bridge plate 170, thereby positioning the forward end portion of the stack over the forward position of the gap 3 (FIG. 8). A plate 171 is slidable on rods 172 extending longitudinally of the apparatus between plates 169 and 170 into engagement with the rearward end 7 of the stack. The plate 171 is provided with sleeves 173 slidable on the rods having set screws 174 for holding the plate 171 in its adjusted position engaging the rearward end 7 of the stack.

As shown in FIGS. 8 and 12, with the carriage 29 in its forward position, the gap 3 is wide open and located adjacent the forward end 7 of the stack. With the carriage 29 dwelling in its forward position, and with the gap 3 open, the loop former and gripper device 13 raised as shown in FIGS. 8 and 12 so that the rollers 141 and 143 of the device 13 are in engagement with the bottom surface of the bottom workpiece W1 exposed in the gap, the feed roller is rotated (counterclockwise as viewed in FIG. 12) to feed rearward the portion W1*a* of the bottom workpiece W1 of the stack lying forward of the roller 143 to form the loop L in the bottom workpiece. The latter is held against rearward movement at W1*b* (see FIG. 12) where it engages the forward end of the upper reach 69 of the rearward belt 53. The loop is formed extending down into the gap 3 between the rollers 141 and 143. It enters the nip of the rollers as shown in FIG. 12, and is gripped or pinched therebetween for being pulled down when the device 13 subsequently moves down.

Means indicated generally at 175 is provided for pressing the stack S down on the raised feed roller 141 for establishing sufficient frictional contact between the bottom workpiece W1 and the feed roller 141 for the feed roller to pull the stated rearward portion W1*a* of the bottom workpiece rearward (toward the left as viewed in FIG. 12) for forming the loop L when the feed roller is rotated counterclockwise as viewed in FIG. 12. In this regard, it will be observed that the feed roller 141, when rotated counterclockwise, must have sufficient frictional engagement with the rearward end portion W1*a* of the bottom workpiece to pull it rearward out from between the second workpiece from the bottom of the stack and the upper surface of reach 101 of the forward belt 55. As illustrated, means 175 comprises a pressure platen 177 at the lower end of piston rod 181 extending down from piston 182 in an air cylinder 183 having its rod end secured to a bridge 185 extending transversely of the apparatus generally above the forward position of the gap 3. The bridge is pivoted at one end on an abutment 187 at one side of the apparatus and releasably locked down as indicated at 188 at its other end on an abutment at the other side of the apparatus, the arrangement being such that the bridge may be swung up and out of the way for placement of a stack S in position for separation and feeding of the bottom workpieces, one after another, then swung back to extend over the stack and locked in position for application of pressure on the stack by the platen 177.

Figure 15:
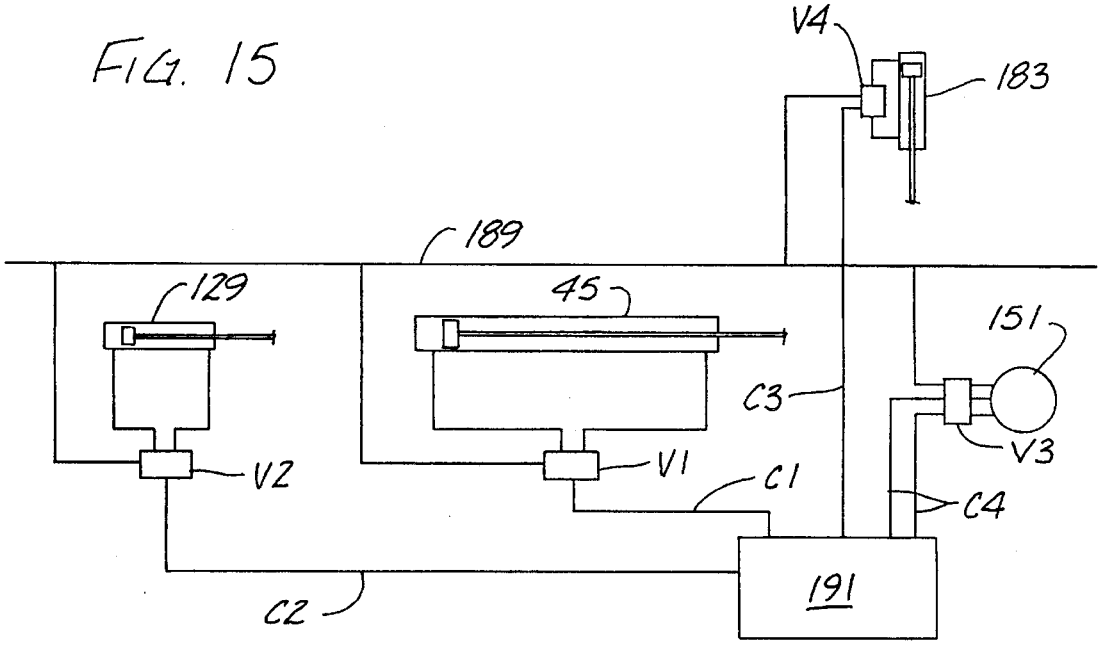
FIG. 15 is a diagram of the pneumatic circuitry of the apparatus.

Referring to FIG. 15, there is indicated at V1 a valve for controlling the carriage drive air cylinder 45, at V2 a valve for controlling the gap control air cylinder 129, at V3 a valve for controlling the rotary air motor 151, and at V4 a valve for controlling the pressure platen air cylinder 183. At 189 is indicated a compressed air supply for supplying the valves with compressed air. The valves V1, V2, V3 and V4 are under control of a controller 191, such as a Shark X-903 programmable controller sold by Reliance Electric Corp. through their dealers in major cities, connections between the controller and the valves V1, V2, V3 and V4 being indicated at C1, C2, C3 and C4. With a stack S in place as illustrated in FIGS. 1, 8 and 12, under the control of the controller 191 the air cylinder 45 is actuated to reciprocate the carriage 29 (the support for the stack) in cycles, in each of which the carriage is driven rearward from its forward position of FIG. 1 through a rearward stroke to its rearward position of FIG. 2 and then through forward stroke back to its forward position of FIG. 1. The carriage dwells briefly in each of its forward and rearward positions. In the forward position of the carriage 29, with the rearward lower rails 37*a* in their retracted position relative to the carriage 29 (as retracted by the air cylinder 129) the gap 3 is situated in its forward position adjacent the forward end of the stack S1 and is wide open, i.e., the forward end of the rearward belt 53 (where the rearward belt is trained around belt guide roller 59) is relatively widely spaced rearward of the rearward end of the forward belt 55 where the forward belt is trained around roller 61. As the carriage 29 is driven forward through a forward stroke, the cams 167 on the side rails 31 of the carriage 29 engage the cam follower rollers 165 on the upper ends of the fingers 163 on the pivot arms 145 of the loop former and gripper assembly 13. These arms are thereby swung upwardly, raising the feed roll 141 and the gripper roll 143 into engagement with the bottom surface of the bottom workpiece W1 of the stack in the gap at 3, as appears in FIGS. 8 and 12. The rolls 141 and 143, so raised, are situated between the forward end 53A of the rearward belt and the rearward end of the forward belt. Under control of the controller 191, the air cylinder 183 is actuated to move the pressure platen 177 down into engagement with the top of the stack (above the rolls 141 and 143) thereby to press the stack down on these rolls to assure sufficient frictional engagement of the roll 141 with the bottom workpiece W1 for the rearward feed of the stated forward end portion W1*a* of the bottom workpiece. Under control of the controller 191, the rotary air motor 151 is driven to rotate the feed roll 141 in counterclockwise direction as viewed in FIG. 12 to feed said forward end portion W1*a* of the bottom workpiece W1 rearward to form the loop L. The forward end portion W1*a* of the bottom workpiece is pulled out from between the next workpiece above and the upper surface of the reach 101 of the forward belt 55. With the bottom workpiece held against rearward movement at W1*b* (see FIG. 12), the loop is formed extending down into the gap 3 between the rollers 141 and 143, enters the nip of these rollers and is gripped or pinched therebetween for being subsequently pulled down.

Following the dwell of the carriage 29 in its stated forward position for the formation and gripping of the loop L by the loop former and gripper device 13, under control of the controller 191 air cylinder 45 is actuated to drive the carriage 29 rearward back through its rearward stroke to its rearward position of FIGS. 2 and 9, thereby moving the gap 3 back to its rearward position shown in FIG. 9. Air cylinder 183 is deactuated to relieve the pressure of platen 177 on the stack. As the carriage 29 moves rearward, the cam follower rollers 165 ride down the cams 167, and the loop former and gripper device 13 is lowered (under its weight) down toward its lowered retracted position of FIG. 13. With the loop L gripped between rollers 141 and 143 of the device 13, the bottom workpiece W1 is pulled down, angling downward and forward from around the forward end of the rearward belt 53. As the carriage 29 continues to move rearward, with rollers 141 and 143 having moved downward from between the forward end of belt 53 and the rearward end of the belt 55, the rearward end of the belt 55 at roller 61 engages the upper surface of the partly separated bottom workpiece W1 and passes between the bottom workpiece and the next workpiece W2 above to peel the bottom workpiece down away from the next workpiece above. Under control of the controller 191, when the carriage 29 has moved rearward through its rearward stroke and the forward end of the belt 53 has moved from under the rearward end of the bottom workpiece thus freeing it, the rotary motor 151 is driven through a fraction of a revolution in reverse direction to release the loop L from being gripped between rollers 141 and 143, and the thus released workpiece drops down on to the take-away conveyor 15 for being carried away.

The carriage 29 is moved rearward through its rearward stroke to its rearward position of FIG. 2 with the lower rearward carriage rails 37*a* retracted so that the gap 3 is wide open. For the return of the carriage 29 through its forward stroke back to its forward position, under control of the controller 191, the cylinder 129 is actuated to drive the side rails 37*a* to their advanced position relative to the carriage 29 thereby shifting belt guide rollers 57 and 59 forward relative to the main carriage rails 31 to close the gap 3, as illustrated in phantom in FIG. 9. Thus the gap 3 is closed on the forward stroke of the carriage to avoid entry of the bottom workpiece in the gap. When the carriage returns to its forward position, when control of the controller 191 cylinder 129 is actuated to retract the rail 37*a* and the rollers 57 and 59, thereby to open the gap for the next cycle of operation.

In view of the above, it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. The method of separating the bottom workpiece from a stack of workpieces of limp material comprising:

supporting the stack at the bottom thereof on a support with a gap in the support for exposing a portion of the bottom surface of the bottom workpiece extending completely across the bottom workpiece;

moving the support in cycles in each of which the gap is moved in one direction constituting a rearward direction from a first position through a stroke in said one direction to a second position and then moved in the opposite direction constituting a forward direction through a stroke in said opposite direction back to said first position;

the stack being held against movement while the support moves thereunder;

the gap when in its said first position being located adjacent one end of the stack constituting its forward end and the stroke in said one direction constituting a rearward stroke and the stroke in said opposite direction constitutes a forward stroke relative to the stack, said first position thus constituting a forward position, and wherein the portion of the bottom workpiece exposed in the gap is moved in the rearward direction out from under the next workpiece to form a loop;

the gap having a dwell in its said forward position at the end of its stroke in said forward direction;

moving the portion of the bottom workpiece exposed in the gap while the gap dwells in its said forward position to form the loop in the bottom workpiece, the loop extending down into the gap, pinching the loop on opposite sides of the loop to grip the loop and pulling it down while the gap moves in said rearward direction in the course of its stroke in said rearward direction, the portion of the support on that side of the gap in said forward direction passing between the bottom workpiece and the next workpiece above to peel the bottom workpiece down away from the next workpiece above, and releasing the grip on said loop to release said bottom workpiece for being carried away.

2. The method of claim 1 wherein a feed member is engaged with the bottom surface of the bottom workpiece exposed in the gap while the gap dwells in its said forward position, the feed member being moved in a direction to move the portion of the bottom workpiece in the rearward direction to form the loop.

3. The method of claim 2 wherein the feed member is a feed roller which is rotated in the direction to move the portion of the bottom workpiece in the rearward direction to form the loop and wherein the loop is fed by the feed roller between the feed roller and a pinch roller for pinching the loop on opposite sides of the loop.

4. The method of claim 3 wherein the feed roller and pinch roller are moved down while pinching and gripping the loop and the feed roller is rotated in a second direction to feed the loop out from between the rollers for releasing the grip on the loop.

5. The method of claim 2 wherein the stack is pressed down on the feed member at the gap when the gap is in its said forward position.

6. The method of claim 1 wherein the gap is narrowed for the forward stroke and widened at the end of said forward stroke.

7. The method of claim 1 wherein the peeled-away workpiece is deposited when released on a take-away conveyor for being carried away.

8. Apparatus for separating the bottom workpiece from a stack of workpieces of limp material comprising:

a support for supporting the stack at the bottom thereof with a gap in the support for exposing a portion of the bottom surface of the bottom workpiece extending completely across the bottom workpiece;

said support being movable underneath the stack to move the gap in one direction constituting a rearward direction from a first position through a stroke in said one direction to a second position and movable in the opposite direction constituting a forward direction through a stroke in the opposite direction back to said first position;

means for holding the stack against movement while the support moves thereunder;

a drive for the support for moving the gap in cycles in each of which the gap is moved in said one direction from its first position to its second position and then moved back from its second position to its first position;

the gap when in its said first position being located adjacent one end of the stack constituting its forward end and the stroke in said one direction constituting a rearward stroke and the stroke in said opposite direction constituting a forward stroke relative to the stack, said first position thus constituting a forward position, and wherein the portion of the bottom workpiece exposed in the gap is moved in the rearward direction out from under the next workpiece to form a loop;

the gap having a dwell in its said forward position at the end of its stroke in said forward direction;

a loop former and loop gripper device moveable up and down between a raised position engaging the bottom surface of the bottom workpiece exposed in the gap while the gap dwells in its said forward position and a lowered retracted position;

means for operating said loop former and loop gripper device when in the raised position to form the loop in the bottom workpiece with the loop extending down into the gap, and to pinch the loop on opposite sides of the loop thereby to grip the loop and pull it down on the downward movement of the loop former and loop gripper device to the lowered retracted position;

said drive for said support acting to move the gap from its forward to its rearward position concurrently with the downward movement of the loop former and loop gripper device so that the portion of the support on that side of the gap in said forward direction passes between the bottom workpiece and the next workpiece to peel the bottom workpiece down away from the next workpiece above; and the loop being released to release the bottom workpiece for being carried away.

9. Apparatus as set forth in claim 8 wherein the loop former and loop gripper device comprises a feed member, means for moving the feed member upward from a lowered position to a raised position engaging the bottom surface of the bottom workpiece exposed in the gap while the gap dwells in its said forward position, and a drive for the feed member for driving it in a direction to move the portion of the bottom workpiece in a rearward direction to form the loop, and means movable up and down with and movable relative to the feed member toward and away from the feed member for engaging the loop on one side thereof and pressing the loop against the feed member to grip the loop on opposite sides of the loop between said loop pressing means and said feed member.

10. Apparatus as set forth in claim 9 wherein said feed member comprises a feed roller and said drive for the feed member rotates the feed roller in the direction to move the portion of the bottom workpiece in the rearward direction to form the loop.

11. Apparatus as set forth in claim 10 wherein said loop pressing means comprises a pinch roller and wherein the feed roller and said pinch roller are moved down while gripping the loop and the drive for the feed roller rotates the feed roller in a second direction to feed the loop out from between the rollers for releasing the grip on the loop.

12. Apparatus as set forth in claim 9 having means for pressing down on the stack at the gap when the gap is in its said forward position.

13. Apparatus as set forth in claim 8 wherein the support comprises means for narrowing and widening the gap, said narrowing and widening means being operable at the end of said rearward stroke of the gap to narrow said gap and hold said gap narrowed on the forward stroke, and for widening said gap at the end of the forward stroke.

14. Apparatus as set forth in claim 8 having a take-away conveyor on which the released workpiece is deposited for being carried away.

15. Apparatus as set forth in claim 8 wherein said support comprises a carriage mounted for linear movement through a forward stroke and through a rearward stroke between said first and said second position, a first and a second belt carried by the carriage, guide means for the belts carried by the carriage comprising a first guide adjacent the rearward end of the carriage, a second guide carried by the carriage forward of the first guide defining the rearward edge of said gap, a third guide carried by the carriage forward of the second guide defining the forward edge of said gap, and a fourth guide forward of the third guide adjacent the forward end of the carriage, means fixing a first end portion and a second end portion of the first belt against movement with the carriage, means on the carriage guiding the first belt to have a first upper reach extending generally horizontally forward from said fixed first end portion of the first belt to said second guide, a lower reach extending rearward back to the first guide, a second upper reach extending generally forward to said second end portion of the first belt, means fixing a first end portion and a second end portion of the second belt against movement with the carriage, means on the carriage guiding the second belt to a first upper reach extending generally horizontally forward from said first fixed end portion of said second belt to said fourth guide, a lower reach extending rearward to the third guide, a second upper reach extending generally horizontally forward coplanar with the first upper reach of said first belt to said second end portion of said second belt, and said drive being operable to drive the carriage back and forth between its said first and second positions.

16. Apparatus as set forth in claim 15 having means carried by the carriage for shifting the said first and second guides longitudinally with respect to the carriage operable at the end of said rearward stroke of the carriage to shift said first and second guides forward relative to the carriage to narrow the gap and hold it narrowed on said forward stroke, and to shift said first and second guides rearward at the end of said forward stroke to widen the gap and hold it widened on said rearward stroke.

17. Apparatus for separating the bottom workpiece from a stack of workpieces of limp material comprising:

a frame;

a support for supporting the stack at the bottom thereof with a gap in the support for exposing a portion of the bottom surface of the bottom workpiece extending completely across the bottom workpiece;

said support comprising a carriage mounted for linear movement on the frame through a stroke in one direction constituting the forward direction and a stroke in the opposite direction constituting the rearward direction between a forward position of the carriage and a rearward position of the carriage, said carriage having a rearward end and a forward end, a first and a second belt carried by the carriage, guide means for the belts carried by the carriage comprising a first guide adjacent the rearward end of the carriage, a second guide carried by the carriage forward of the first guide defining the rearward edge of said gap, a third guide carried by the carriage forward of the second guide defining the forward edge of said gap, and a fourth guide forward of the third guide adjacent the forward end of the carriage, means fixing a first end portion and a second end portion of the first belt against movement with the carriage, means on the carriage guiding the first belt to have a first upper reach extending generally horizontally forward from said fixed first end portion of the first belt to said second guide, a lower reach extending rearward back to the first guide, a second upper reach extending generally forward to said second fixed end portion of the first belt, means fixing a first end portion and a second end portion of the second belt against movement with the carriage, means on the carriage guiding the second belt to have a first upper reach extending generally horizontally forward from said first fixed end portion of said second belt to said fourth guide, a lower reach extending rearward to the third guide, a second upper reach extending generally horizontally forward coplanar with the first upper reach of said first belt to said second fixed end portion of said second belt;

said carriage being movable underneath the stack to move the gap in the rearward direction from the forward position to the rearward position and movable in the opposite direction back to said forward position;

means for holding the stack against movement while the gap moves thereunder;

a drive for the carriage for moving the gap in cycles in each of which the gap is moved rearward from its forward position to its rearward position and then moved back from its rearward position to its forward position;

the carriage and gap having a dwell in the forward position at the end of its stroke in said opposite direction;

a loop former and loop gripper device moveable up and down between a raised position engaging the bottom surface of the bottom workpiece exposed in the gap while the gap dwells in said forward position and a lowered retracted position;

said loop former and loop gripper device being operable when in the raised position to form a loop in the bottom workpiece with the loop extending down into the gap, and to pinch the loop on opposite sides of the loop thereby to grip the loop and pull it down on the downward movement of the loop former and loop gripper device to the lowered retracted position;

said drive acting to move the gap from its forward position to its rearward position on the downward movement of the loop former and loop gripper device so that the portion of the second belt on that side of the gap in said forward direction passes between the bottom workpiece and the next workpiece to peel the bottom workpiece down away from the next workpiece above; and the loop being released to release the bottom workpiece for being carried away.

18. Apparatus as set forth in claim 17 having means carried by the carriage for shifting the first and second guides longitudinally with respect to the carriage operable at the end of said rearward stroke of the carriage to shift said first and second guides forward relative to the carriage to narrow the gap and hold it narrowed on said forward stroke, and shifting said first and second guides rearward at the end of said forward stroke to widen the gap and hold it widened on said rearward stroke.

* * * * *